United States Patent [19]

Lamy

[11] 4,285,614

[45] Aug. 25, 1981

[54] STRUCTURE ALLOWING THE ATTAINMENT OF A PRECISE SEABED LOCATION

[75] Inventor: Jacques E. Lamy, Fontenay-Aux-Roses, France

[73] Assignee: Compagnie Generale pour les Developpements, Paris, France

[21] Appl. No.: 966,552

[22] Filed: Dec. 5, 1978

[30] Foreign Application Priority Data

Dec. 5, 1977 [FR] France ..... 77 36508

[51] Int. Cl.[3] ..... E02B 17/02

[52] U.S. Cl. ..... 405/203; 405/224

[58] Field of Search ..... 405/195, 203, 204, 205, 405/207, 208, 218, 224–228; 166/366; 175/9

[56] References Cited

U.S. PATENT DOCUMENTS

| | | | |
|---|---|---|---|
| 2,217,879 | 10/1940 | Willey | 405/204 X |
| 2,326,353 | 8/1943 | Gross | 405/226 |
| 2,334,992 | 11/1943 | Crake | 405/205 |
| 3,007,316 | 11/1961 | Higgins | 405/207 |
| 3,716,994 | 2/1973 | Pogonowski | 405/204 |
| 3,938,343 | 2/1976 | Lamy | 405/226 |
| 4,126,008 | 11/1978 | Dixon | 405/207 |

FOREIGN PATENT DOCUMENTS

| | | | |
|---|---|---|---|
| 473849 | 12/1973 | Australia | 405/227 |

*Primary Examiner*—David H. Corbin

*Attorney, Agent, or Firm*—Wigman & Cohen

[57] ABSTRACT

A rig which can be towed in floating condition comprises a hollow shaft connected with a base section and supporting a bridge equipped with various installations. In order to allow laying of the base section at a precise location on the seabed, the base section is provided with peripheral notches which can slide along vertical piers and is provided also with piles which are extended and locked when the notches are placed against the piers. Thereafter, the base section is allowed to sink to the bottom by sliding against the piers. Such a rig is useful for oil drilling purposes.

3 Claims, 11 Drawing Figures

STRUCTURE ALLOWING THE ATTAINMENT OF A PRECISE SEABED LOCATION

BACKGROUND OF THE INVENTION

1. Field of the Invention

The invention relates to rigs comprising a structure integral with a base section designed to sit on the bottom of the sea or of a water expanse, for supporting above the water level a deck carrying scientific or industrial installations such as oil drilling installations.

2. Description of the Prior Art

The base section and/or the structure can form one or more ballastable floats, or else the deck can form a float movable along the structure. It is thus possible to build the rig on the ground, then to launch and tow it up to its laying site at which it is sunk down to the bottom by progressively ballasting the base section and/or the structure, and/or by progressively displacing the deck upwards along the structure. This laying procedure clearly does not allow the installers to lay the base section upon a precise location of the bottom of the sea or of the water expanse, as exemplified by a drilling template, and even less to fit vertically above such a location a device borne by the deck, e.g., a drilling derrick.

SUMMARY OF THE INVENTION

One of the objects of the present invention is to allow constructing a rig so that its base section can be laid at a precise location on the bottom of the sea or of the water expanse.

A further object is to allow constructing a rig, the base section of which can be laid in such a way that the deck overhangs a precise location of the bottom.

A still further object of the invention is to provide a process for laying such a rig.

According to the invention, the base section comprises at least two peripheral notches respectively slidable along vertical piers fitted at the bottom of the sea or of the water expanse. In order to determine the laying location, there are at least three piles housed in vertical guides, and means for extending these piles under the base section and locking them in this position.

It is thus possible, after having ballasted the rig so that its base section descends below the top level of the piers without touching the bottom, to bring with the assistance of towboats the rig connected to the bottom by one or more mooring lines, into a position in which the notches engage the piers, then to extend the piles and to ballast once more the rig so that the base section slides down to the bottom along the piers while driving the piles into the undersea ground.

In an embodiment, the structure is constituted by a hollow shaft arranged eccentrically relative to the base section towards the notches, and the deck is cantilevered so as to overhang a region located beyond these notches. The hollow shaft conveniently supports, under the overhang of the deck, a metal network which in turn carries guides designed to maintain drilling directive tubes.

DETAILED DESCRIPTION OF THE PREFERRED EMBODIMENT

Figure 1:
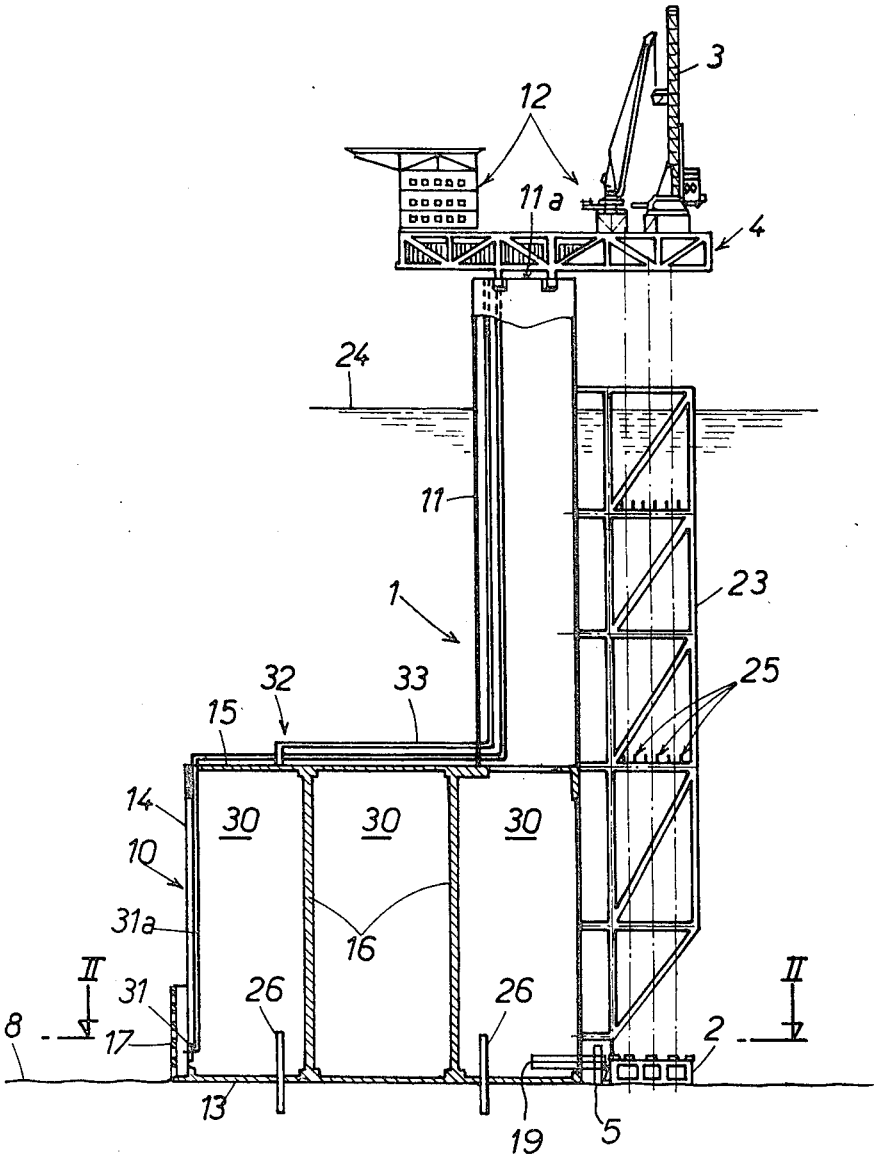
FIG. 1 is a diagrammatic section taken along line I—I of FIG. 2, showing a rig according to the invention laid upon the seabed for the utilization of a drilling template.
Figure 2:
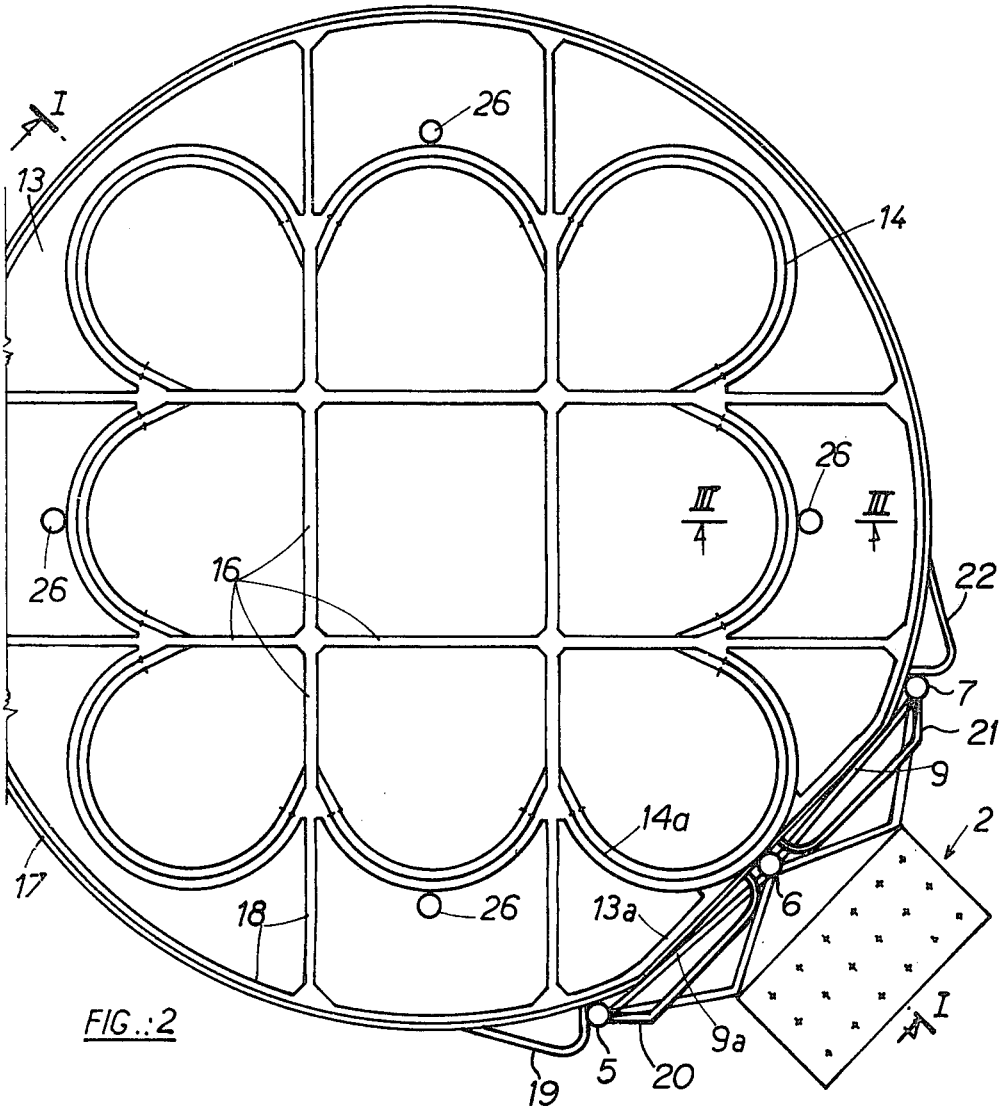
FIG. 2 is a diagrammatic cross-section taken along line II—II of FIG. 1.

The rig 1, shown schematically on FIGS. 1 and 2, is a "gravity" type rig, i.e., a rig resting on the seabed by its own weight. It is meant to be laid adjacent an undersea drilling template 2 having served for drilling hydrocarbon producing wells, in order to allow completion of these wells by means of a derrick 3 fitted on the deck 4 of the platform.

Figure 4:
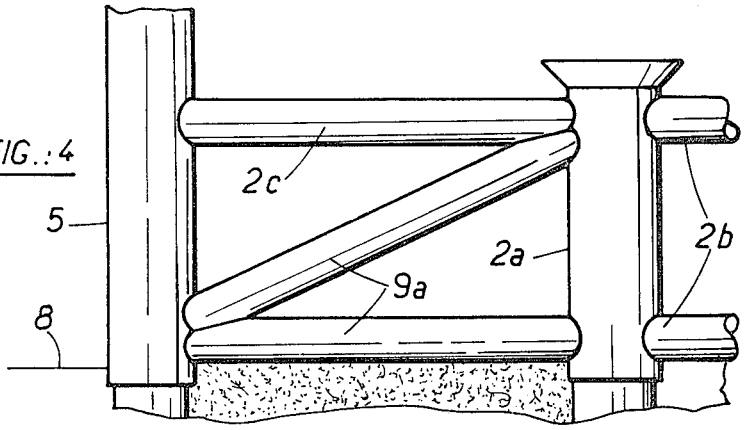
FIG. 4 is a large scale vertical section of part of the drilling template.
Figure 2B:
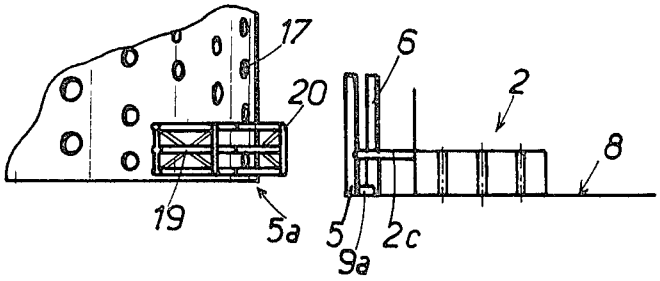
FIG. 2*b* is a view along arrow F of FIG. 2*a*.
Figure 2A:
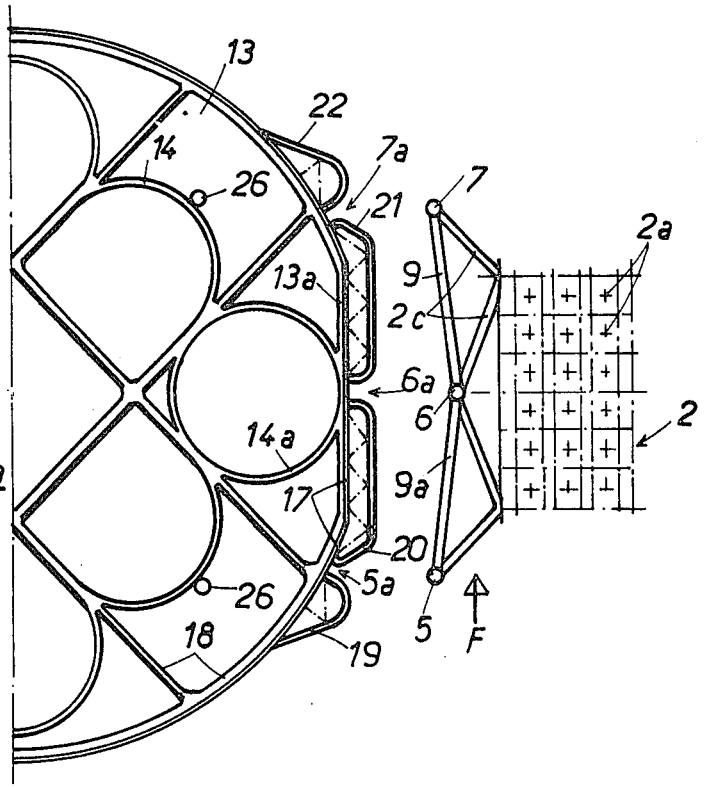
FIG. 2*a* is a fragmentary view similar to FIG. 2, showing the rig as it approaches the template.

The template 2 comprises, as is well known, a plurality of vertical tube portions 2*a* which are juxtaposed and strutted by elements 2*b* (FIG. 4) to serve as guides for drilling wells. In the illustrated embodiment, it is further connected by other struts 2*c* to three vertical piers 5, 6 and 7 (FIG. 2*a*) which are firmly sunken into the undersea ground 8 (FIG. 2*b*) close to one of the sides of the template 2 and the feet of which are connected to each other and to the drilling template 2 by horizontal braces 9, 9*a* (FIG. 2*a*). This template 2 has been positioned and used in known manner, by a rig of semi-submersible type (not shown) secured to the seabed 8 by mooring lines, to start drilling the wells while the rig 1 is being built.

The rig 1 comprises (FIG. 1) a base section 10 made of concrete, and a watertight hollow shaft 11 provided with an upper bottom 11*a*, also made of concrete, carrying the concrete or steel deck 4 which bears the installations generally indicated by reference numeral 12.

The base section 10 comprises a slab 13 supporting a lobed-square-shaped upright wall 14 provided with an upper bottom 15 so as to form a watertight chamber divided into compartments 30 by bulkheads 16. Slab 13 has the shape of a circular disc truncated by a chord 13*a* (FIG. 2) which is tangent to an angle lobe 14*a* of wall 14 at the end of the corresponding diagonal of the lobed square.

The periphery of slab 13 supports an anti-undermining ported wall 17 according to the teaching of U.S. Pat. No. 3,878,684 and the slab portion located outside the lobed wall 14 is stiffened by ribs 18. Ported wall 17 supports, above the truncated portion 13*a* and the adjacent portion of slab 13, protrusions 19, 20, 21, 22 (FIG. 2*a*) of smaller height than piers 5, 6, 7, which determine wide-mouthed notches 5*a*, 6*a*, 7*a* designed to engage respectively these piers 5, 6, 7 (see FIGS. 2, 2*a*, 2*b*).

The hollow shaft 11, centered eccentrically with respect to the base section 10, is located on the extension of angle lobe 14*a*, and the deck 4 carried on top of this hollow shaft 11 comprises a cantilever portion which overhangs the protrusions 20, 21 and extends beyond these over a distance greater than the width of template 2 (see FIG. 1). A metal network 23 (which is not shown on FIGS. 2, 2*a*, 2*b*) is secured to the hollow shaft 11 beneath this cantilever portion of deck 4 and hence right above protrusions 19–22 due to said overhang of the cantilever portion of deck 4. The hollow shaft 11 has a sufficient height for the deck 4 to be above the water surface 24 when the slab 13 rests on the seabed 8, and the metal network 23 then extends between a level slightly above surface 24 and a level slightly above seabed 8 and adjacent to, though clear of, piers 5–7 of template 2, as illustrated in FIGS. 1, 2, 5*b*, and 5*c*. The network 23 carries at regular intervals guides 25 adjustable in every direction in the horizontal plane, which are designed to maintain drilling conductive tubes (not shown) serving, when the rig 1 occupies the position of FIG. 1, to drill wells through the tube portions 2*a* of template 2 by means of derrick 3.

Figure 3:
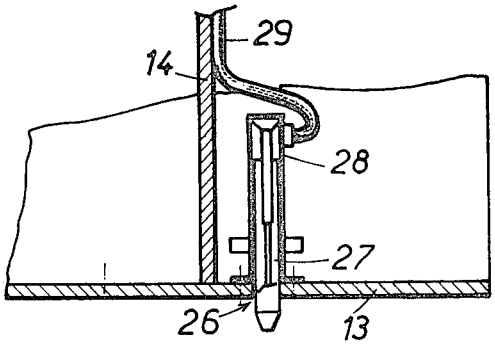
FIG. 3 is a larger scale section taken along line III—III of FIG. 2.

Four openings 26 are formed through slab 13 and a pile 27 (FIG. 3) is threaded through each of these and can be pushed outwardly by a hydraulic or pneumatic pressure acting in a cylinder 28 connected to a pipe 29 extending upwards along the wall of the hollow shaft 11 up to a control device located on the deck 4 and adapted for switching to exhaust and to a pressure fluid source (not shown). The compartments 30 (FIG. 1) of the base section and the hollow shaft 11 are each provided: at their lower part, with a flooding and unballasting orifice 31 connected via a pipe 31*a* to a manifold (not shown) which is controllable from the deck 4 for being supplied with water or connected to exhaust pumps; and, at their upper part, with a blow-off orifice 32 connected via a pipe 33 to a vent located on the deck. It is thus possible to ballast each compartment 30 with a desired amount of water, by operating the manifold for supply of water during a suitable period, and to withdraw the water by communicating the manifold with the pumps.

Figure 5A:
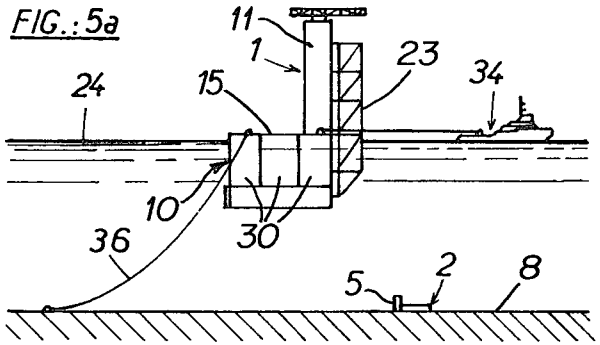
FIGS. 5, 5*a*, 5*b*, 5*c* and 5*d* are diagrammatic elevations illustrating various steps of the laying of the rig.
Figure 5:
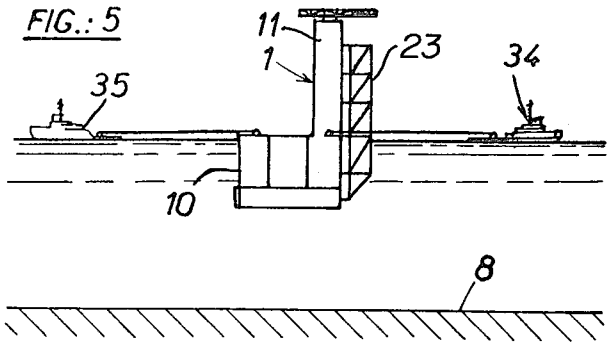
Figure 5B:
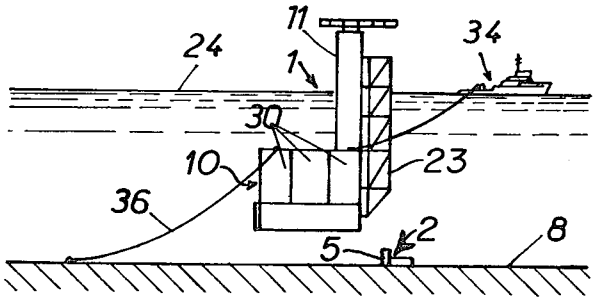

The positioning of the rig 1 is carried out after removal of the semi-submersible rig (not shown). FIG. 5 shows the rig 1 floating upon its base section 10 and being towed by towboats one of which is shown at 34 a smaller tugboat 35 exerts a retaining force. In FIG. 5*a*, rig 1 has arrived near template 2; it is moored head to wind at the opposite side thereof by means of two mooring lines shown diagrammatically at 36, and held in balance between these mooring lines and the towboats, such as 34, which pull towards the template 2. The exact positioning of the rig 1 with respect to the template 2 can be carried out by any suitable means, e.g., the acoustic ranging and spotting process disclosed in French Pat. No. 1417248. The various compartments 30 are progressively ballasted as described, so that the base section 10 progressively sinks, the rig 1 being supported by the float constituted by the hollow shaft 11 (FIG. 5*a*). To this effect, the base section 10 of the rig 1 is first immersed up to the level of its upper bottom 15 by simultaneously ballasting all the compartments 30 with water. Then, in order to avoid an inclination of the rig 1, only the hollow shaft 11 is ballasted (FIG. 5*b*). The mooring lines 36 and the pull of the towboats, such as 34, are at the same time adjusted so that the base section 10 of the rig 1, upon its arrival at five or six meters above the seabed 8, is a few meters away from template 2, with the notches 5*a*, 6*a*, 7*a* of the protrusions 19, 20, 21, 22 being opposite the piers 5, 6, 7 (position shown in FIGS. 2*a* and 2*b*). As seen in FIG. 2*b*, in this position, the top of the protrusions 19, 20, 21, 22 are entirely underneath the top of the piers 5, 6, 7.

Figure 5C:
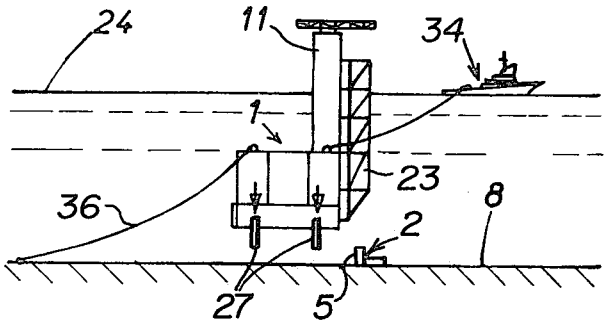
Figure 5D:
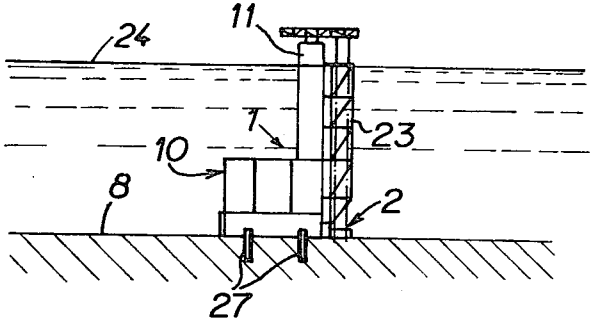

It is therefore sufficient to release very slightly the mooring lines 36 for the towboats 34 and 35 to bring the rig 1 to a position at which the piers 5, 6, 7 respectively engage the notches 5*a*, 6*a*, 7*a* (FIG. 5*c*). The piers 5, 6, 7 thus serve as stops which allow maintaining the rig 1 in equilibrium in such position, under the joint actions of the mooring lines 36 and the towboats 34 and 35, while the above-mentioned control devices (not shown) are actuated to pressurize the cylinders 28, which causes the piles 27 to extend about four meters (see FIG. 5*c*). It is then enough to lock the piles 27 in that position (e.g., by keeping cylinders 28 under pressure or by means of a locking mechanism, not shown), and to ballast anew the hollow shaft 11 so that the base section 10 sits on the seabed 8 by sliding vertically against the piers 5, 6, 7 (FIG. 5*d*), driving the piles 27 into the undersea ground 8 to thus preclude horizontal displacement of the rig 1 with respect to the template 2. If the position of the rig 1 is deemed incorrect, the hollow shaft 11 can be slightly unballasted and the operation resumed, i.e., the towboats 34 and 35 and/or mooring lines 36 are maneuvered so that the notches 5*a*, 6*a*, 7*a* re-engage the piers 5, 6, 7 and the hollow shaft 11 is ballasted anew to lay base section 10 upon the seabed 8. When the position is correct (FIG. 1), the compartments 30 are ballasted once more to be filled with water, and the rig 1 is freed from its mooring lines 36 and towboats 34 and 35.

Obviously, the embodiment described above is just an example and it could be modified notably by the substitution of technical equivalents. In particular, two piers such as 5 and 7 would theoretically suffice for perfectly positioning the rig 1 with respect to the location exemplified by the template 2, but it would also be possible to provide for four or more piers. Likewise, three piles 27 would theoretically be enough to maintain the rig 1 against the piers 5, 6, 7 during the terminal phase of its positioning, but it would also be possible to provide for five or more piles. The piles 27 could be driven in by mechanical means. Instead of using mooring lines 36 and towboats 34 and 35 for positioning the rig 1, only mooring lines 36 could be used by adjusting their tension by means of winches or capstans.

I claim:

1. A process for a precise in situ seating of a buoyant rig upon a seabed bottom at an offshore location established by a seabed work template, comprising the steps of:

towing the buoyant rig afloat to a sea-surface position close to the offshore location;

partially ballasting the buoyant rig for intermediate submergence thereof above the seabed bottom and down to a depth such that horizontally spaced notches defined by a plurality of protrusions at a periphery of a base section of the buoyant rig are at a level lower than tops of horizontally spaced piers driven into the seabed bottom adjacent to the seabed work template, whereby said spaced notches are in horizontal matching register with respective ones of said spaced piers;

horizontally displacing the buoyant rig, while in said intermediate submergence, for engagement of said spaced piers by said spaced notches respectively;

downwardly projecting piles from retracted positions towards the seabed bottom;

locking firmly said piles in such downwardly projecting position to preclude retraction thereof; and further ballasting the rig for grounding said base section thereof on the seabed bottom, while said rig is vertically guided by the cooperative engagement of respective ones of said spaced notches with said spaced piers, and while said downwardly projecting piles are driven into the seabed bottom.

2. A rig constructed for being towed afloat and grounded upon the seabed bottom at a precise offshore location defined by a plurality of spaced piers driven into the seabed bottom adjacent to a seabed work template, said rig comprising:

a generally circular base section having at a single circumferential section of its periphery a plurality of protrusions defining a plurality of notches being horizontally spaced for respective mating engagement with the plurality of spaced piers;

retractable piles capable of being selectively downwardly projected into a position beneath the base section so as to depend therefrom;

means for locking the retractable piles into the projected position;

means for ballasting the rig so as to submerge and ground the rig on the seabed bottom;

a shaft centered eccentrically with respect to said base section, in the direction of said horizontally spaced notches; and an upper deck portion supported above the water surface by said shaft and overhanging said seabed work template when said plurality of spaced notches and said plurality of spaced piers are in respective mating engagement at said seabed work template.

3. An offshore assembly resting upon the seabed at a precise location thereof, comprising the following combination of structural seabed components:

an undersea grouping including a sea-floor work template and a plurality of horizontally-spaced locating piers being dug into the seabed adjacent to said work template, and said plurality of piers having a portion projecting upward from the seabed;

a subsequently submerged rig being grounded upon the seabed and including a submerged base having at its periphery above the seabed a plurality of protrusions defining spaced locating notches arranged for respective mating engagement with said upward projecting portion of said horizontally-spaced locating piers, and said submerged base further having anchoring piles being connected to said submerged base and projecting downwardly therefrom for digging into the seabed;

wherein the subsequently submerged rig further includes a shaft extending upwards from the submerged base to a position above the sea surface and being eccentrically offset with respect to the base towards said spaced locating notches, and an elevated deck being supported by the shaft at an upper end thereof and overhanging vertically the sea-floor work template.

* * * * *

UNITED STATES PATENT AND TRADEMARK OFFICE

CERTIFICATE OF CORRECTION

PATENT NO. : 4,285,614

DATED : August 25, 1981

INVENTOR(S) : Jacques E. Lamy

It is certified that error appears in the above—identified patent and that said Letters Patent is hereby corrected as shown below:

On the title page, Item [73] Assignee: should read.

--COMPAGNIE GENERALE POUR LES DEVELOPPEMENTS OPERATIONNELS DES RICHESSES SOUS-MARINES "C.G. DORIS"--.

Signed and Sealed this

*Eighteenth* Day of *May 1982*

[SEAL]

*Attest:*

GERALD J. MOSSINGHOFF

*Attesting Officer*

*Commissioner of Patents and Trademarks*